US009323278B2

(12) United States Patent
Masumoto et al.

(10) Patent No.: US 9,323,278 B2
(45) Date of Patent: Apr. 26, 2016

(54) CONTROL LEVER SYSTEM

(75) Inventors: Koji Masumoto, Sakai (JP); Manabu Togo, Okayama (JP)

(73) Assignee: Kubota Corporation, Osaka (JP)

( * ) Notice: Subject to any disclaimer, the term of this patent is extended or adjusted under 35 U.S.C. 154(b) by 160 days.

(21) Appl. No.: 13/590,305

(22) Filed: Aug. 21, 2012

(65) Prior Publication Data

US 2013/0213178 A1 Aug. 22, 2013

(30) Foreign Application Priority Data

Nov. 24, 2011 (JP) ..... 2011-256518

(51) Int. Cl.
*G05G 1/04* (2006.01)
*G05G 25/04* (2006.01)

(52) U.S. Cl.
CPC ..... *G05G 1/04* (2013.01); *G05G 25/04* (2013.01); *Y10T 74/20612* (2015.01)

(58) Field of Classification Search
CPC ..... G05G 1/04; G05G 1/06; G05G 25/04; G05G 11/00; G05G 13/02; E02F 9/2004; Y10T 74/2093; Y10T 74/20582; Y10T 74/20612
USPC ..... 74/519, 566; 180/320–324, 332–333, 180/336, 315; 296/24.34, 37.8
See application file for complete search history.

(56) References Cited

U.S. PATENT DOCUMENTS 4,029,324 A * 6/1977 Berkes ..... 277/507
4,064,767 A * 12/1977 Boersma ..... 74/491
4,610,179 A 9/1986 Parker
8,739,650 B2 * 6/2014 Masumoto ..... 74/523
2003/0033898 A1 2/2003 Morimoto et al.
2011/0284785 A1 * 11/2011 Yoshimoto et al. ..... 251/229

FOREIGN PATENT DOCUMENTS

FR 2851811 A1 * 9/2004 ..... F16H 59/02
JP 58150526 U 10/1983
JP H03-200425 * 9/1991 ..... B60K 20/04
JP 7293670 A 11/1995
JP 2000255281 A 9/2000
JP 2006224840 A 8/2006
JP 2006313396 A 11/2006
JP 2011233008 A 11/2011
WO WO 2010090168 A1 * 8/2010 ..... F16J 15/52

OTHER PUBLICATIONS

Machine translation of JP H03-200425 abstract.*
Machine translation of FR 2851811.*

* cited by examiner

*Primary Examiner* — Richard W Ridley
*Assistant Examiner* — Yamilka Pinero Medina
(74) *Attorney, Agent, or Firm* — The Webb Law Firm

(57) ABSTRACT

A work vehicle includes a frame structure between an operator-side space adjacent to the operator and a device-side space adjacent controlled devices. The control lever system for the work vehicle comprises a pivotal shaft mounted in the vicinity of a lever opening formed in the frame structure; a boss portion supported to the pivotal shaft to be rotatable about the pivotal shaft; a control lever portion radially extending from the boss portion to the operator-side space; a controlled lever portion radially extending from the boss portion to the device-side space; and a seal member for closing a gap between the boss portion and an area of the frame structure where the lever opening is formed.

11 Claims, 6 Drawing Sheets

Fig.3

CONTROL LEVER SYSTEM

TECHNICAL FIELD

The present invention relates to a control lever system for a work vehicle including a frame structure delimiting between an operator-side space adjacent to the operator and a device-side space adjacent to controlled devices.

BACKGROUND

When a control lever extending between the operator-side space and the device-side space is employed, and particularly, when the control lever is arranged to extend through an opening formed in the frame structure such as a floor panel, it is required to prevent dust from entering the operator-side space where the operator is present from the device-side space as much as possible.

According to Japanese Unexamined Patent Application Publication No. 2006-313396 and its similar Publication No. 2006-224840 disclosing a dustproof arrangement for the control lever in a tractor as an example of the work vehicle, the control lever is supported to a pivotal shaft that is mounted in a position distant from the frame structure downward to be oscillatable about the pivotal shaft, and an elongated opening is formed in the frame structure along the oscillating direction of the control lever. An elastic member made of rubber having a slit, through which the control lever extends, to cover the elongated opening and to allow the control lever to be oscillated. Further, a foamed plastic member such as a sponge that is elastically deformable is provided to lie over the elastic member, thereby to close the portion opened through the opening.

In this conventional arrangement, since the foamed plastic member that is elastically deformable is provided to lie over the elastic member, it is prevented that an inner edge of the elastic member where the opening is formed is turned up to produce a gap. On the other hand, since the control lever is moved and operated within the slit-like passage formed in the elastic member, a gap is produced in the member forwardly or rearwardly in the moving direction of the control lever as the control lever is oscillated, as a result of which dust may pass through the gap. Further, owing to the arrangement in which the control lever is freely inserted into both the elastic member and the foamed plastic member, an elastic restoring force of the elastic member or foamed plastic member in the position where the control lever penetrates is abated through a change over the years as the control lever is repeatedly oscillated for a long period of time. That may lead to formation of a gap.

Another control lever system is known from U.S. Pat. No. 4,610,179 in which the elastic member fills between the opening and the lever.

A further control lever system is known from US 2003/0033898 including a boss defining a pivotal axis for the control lever, a control lever portion extending to one direction from the boss, and a controlled lever portion extending to a different direction from the boss.

SUMMARY OF INVENTION

Under the circumstances, it is desired to provide a control lever system employing a proper seal structure to achieve a sufficient dustproof function for the boundary between the operator-side space and the device-side space over a long period of time.

A control lever system according to the present invention for a work vehicle having a frame structure delimiting between an operator-side space adjacent to the operator and a device-side space adjacent controlled devices comprises a pivotal shaft mounted in the vicinity of a lever opening formed in the frame structure; a boss portion supported to the pivotal shaft to be rotatable about the pivotal shaft; a control lever portion radially extending from the boss portion to the operator-side space; a controlled lever portion radially extending from the boss portion to the device-side space; and a seal member for closing a gap between the boss portion and an area of the frame structure where the lever opening is formed.

When the pivotal shaft projects from the boss portion, a gap between the projecting portion of the pivotal shaft and the frame structure is also closed with the seal member. With respect to the positional relationship between the lever opening and the boss portion, the boss portion may be positioned adjacent to the operator-side space in reference to the lever opening or may be positioned adjacent to the device-side space in reference to the lever opening. In any case, what is essential is to close the gap between the lever opening and the boss portion with the seal member in order to prevent foreign matters such as dust from entering the operator-side space from the device-side space.

More particularly, the seal member acts to close the gap between an outer circumference of the boss portion and the frame structure including the floor panel. When the boss portion is cylindrical, the seal member may be provided to come into slide contact with radial opposite sides of the outer circumference of the boss portion. Even if the boss portion is rotated as the control lever is oscillated, a distance is not changed between the position of the outer circumference of the boss portion coming into slide contact with the seal member and the pivotal axis. Therefore, no gap is produced in the position where the seal member slide-contacts the boss portion, as a result of which a high dustproof performance can be achieved.

When employing the arrangement in which the distance is not changed between the position of the outer circumference of the boss portion coming into slide contact with the seal member and the pivotal axis, the seal member is not pushed by the control lever in the position where the boss portion slide-contacts the seal member and thus free from the risk of deformation even if the control lever is repeatedly oscillated over a long period of time. This would extend the life of the seal member as well.

The above-noted effect of the present invention is also achieved in the arrangement in which a plurality of control levers are mounted. Here, it is preferable that the boss portions corresponding to the respective control levers are arranged adjacent to each other on the common pivotal shaft in the axial direction. In that case, not only the entire structure of the control lever system is simplified, but also the seal member may precisely come into slide contact with the boss portions of the respective control levers without complicating the shape of the seal member.

In one preferable embodiment, a cabin is provided in the operator-side space for the operator, the frame structure includes a floor panel and a floor panel support member of the cabin, the pivotal shaft is fixed to the floor panel support member, and the lever opening is formed in the floor panel. Generally, a windshield mounted in the front side of the cabin or an openable/closable door mounted in a lateral side of the cabin is supported to the floor panel support member, and the cabin per se is mounted on the vehicle body through a vibration-proof mount. Hence, vibrations of the vehicle body are less easily transmitted to the floor panel support member. Therefore, as compared with a pivotal shaft fixed to an element connected to the vehicle body, vehicle vibrations are less easily transmitted to the pivotal shaft according to the present invention. In addition, vibrations of the pivotal shaft per se are suppressed. As a result, vibrations transmitted to the control lever portion are diminished compared with the conventional system.

DESCRIPTION OF EMBODIMENTS

An embodiment of the present invention will be described hereinafter in reference to the accompanying drawings in which a dustproof device for a work vehicle according to the present invention is applied to a tractor acting as the work vehicle.

Figure 1:
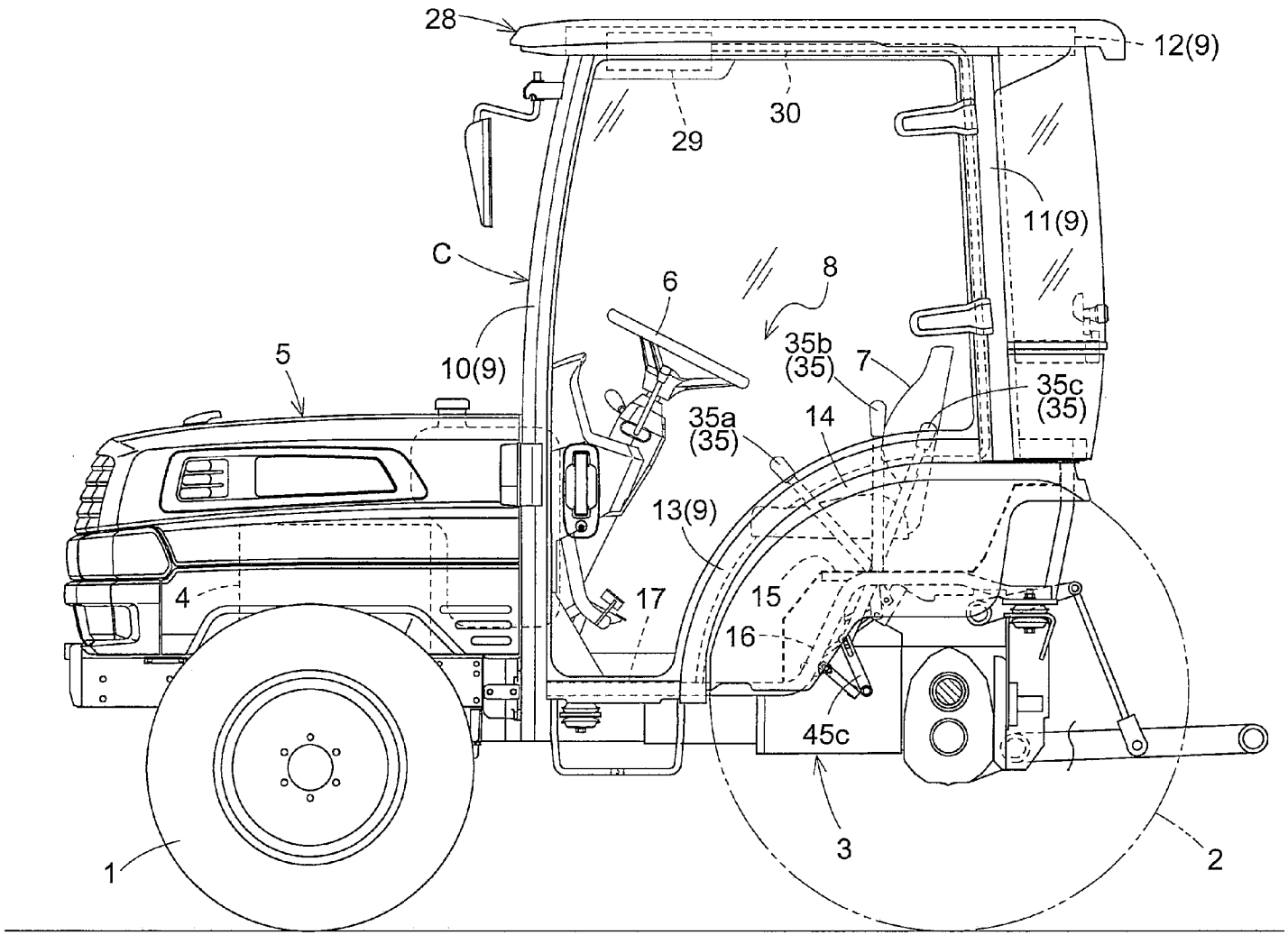
FIG. 1 is an overall side view of a tractor.

As shown in FIG. 1, the tractor includes a pair of right and left steerable drive front wheels 1 and a pair of right and left drive rear wheels 2, both of which are provided in a traveling vehicle body 3. A motor section 5 provided with an engine 4 and the like is mounted forwardly of the traveling vehicle body 3, and a vehicle control section 8 provided with a steering wheel 6, a driver's seat 7 and the like is mounted rearwardly of the traveling vehicle body 3. Further, the tractor includes a cabin C for covering the vehicle control section 8 from above.

The cabin C includes a support frame member 9 having right and left front pillars 10, a right and left rear pillars 11, a ceiling frame 12 connected to upper portions of the front pillars 10 and rear pillars 11 and formed as a circumferential frame, a right and left side frames 13 each extending along an upper side of each rear wheel 2 in an arc for connecting lower ends of the right and left front pillars 10 to lower ends of the right and left rear pillars 11, rear fenders 14 connected to the respective side frames 13, and a floor panel 15 acting as a seat base portion provided between the right and left rear fenders 14. Those elements are integrally connected with the support frame member 9.

Figure 2:
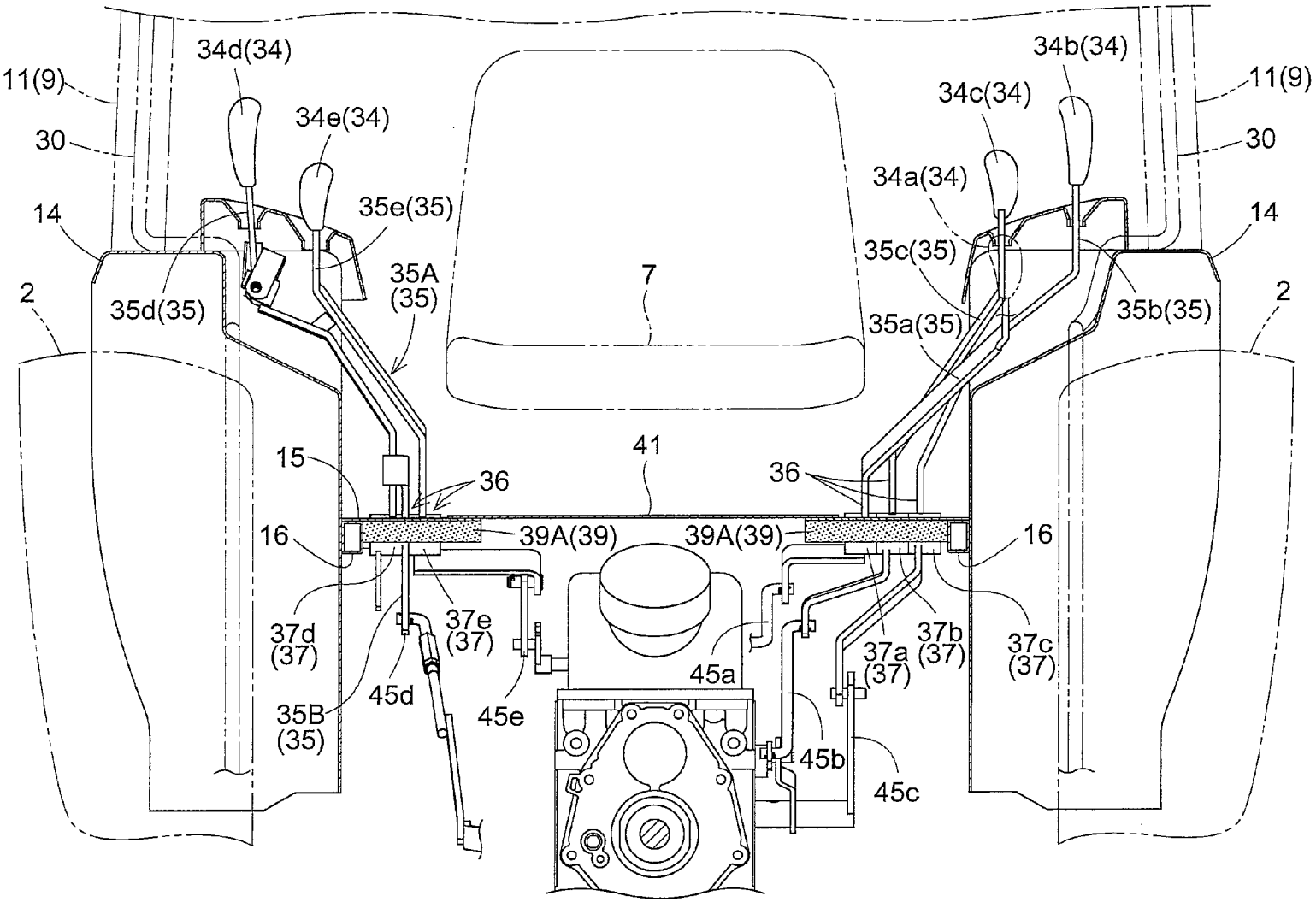
FIG. 2 is a front view of a vehicle control section in vertical section.
Figure 3:
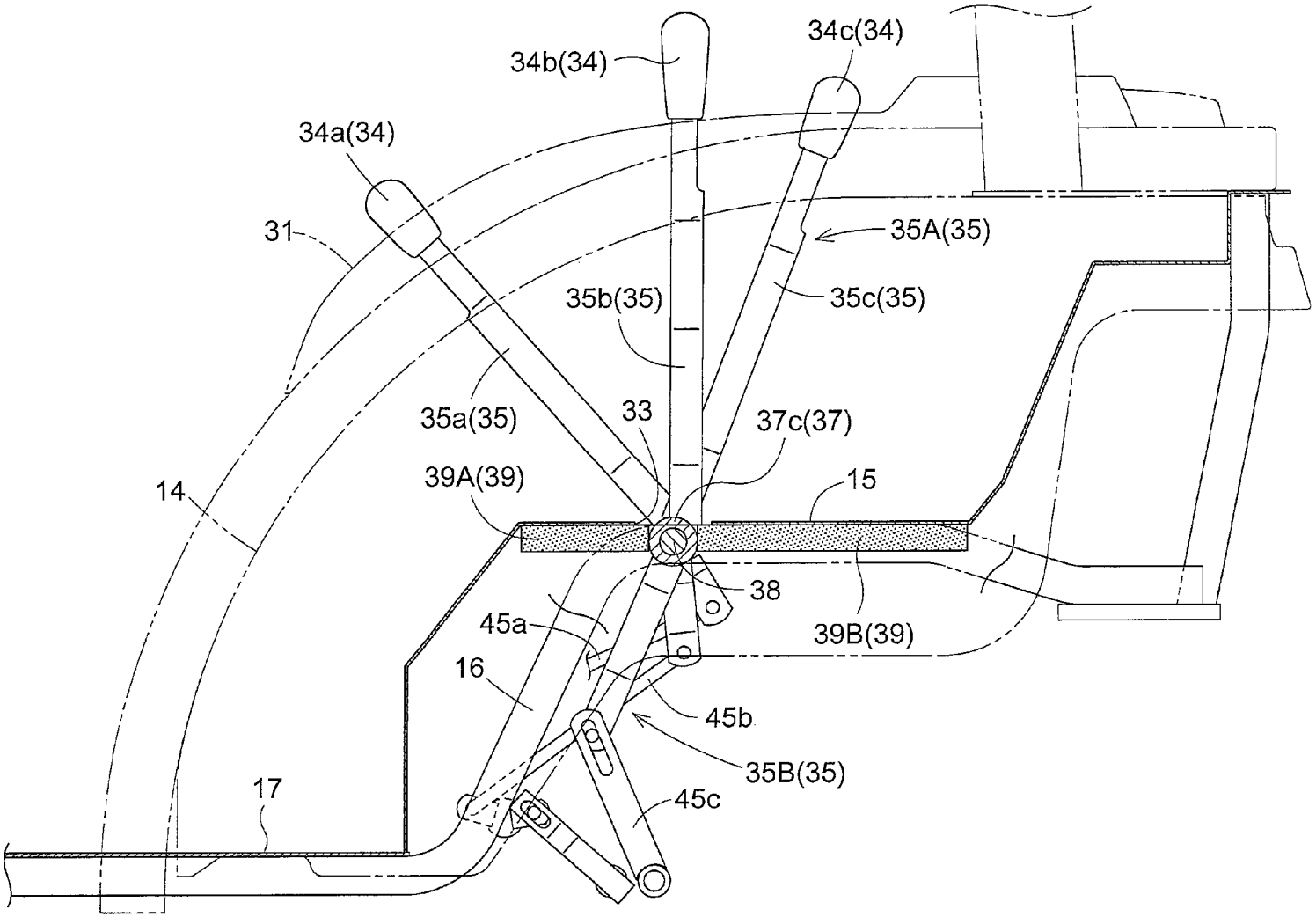
FIG. 3 is a side view of the vehicle control section in vertical section.
Figure 4:
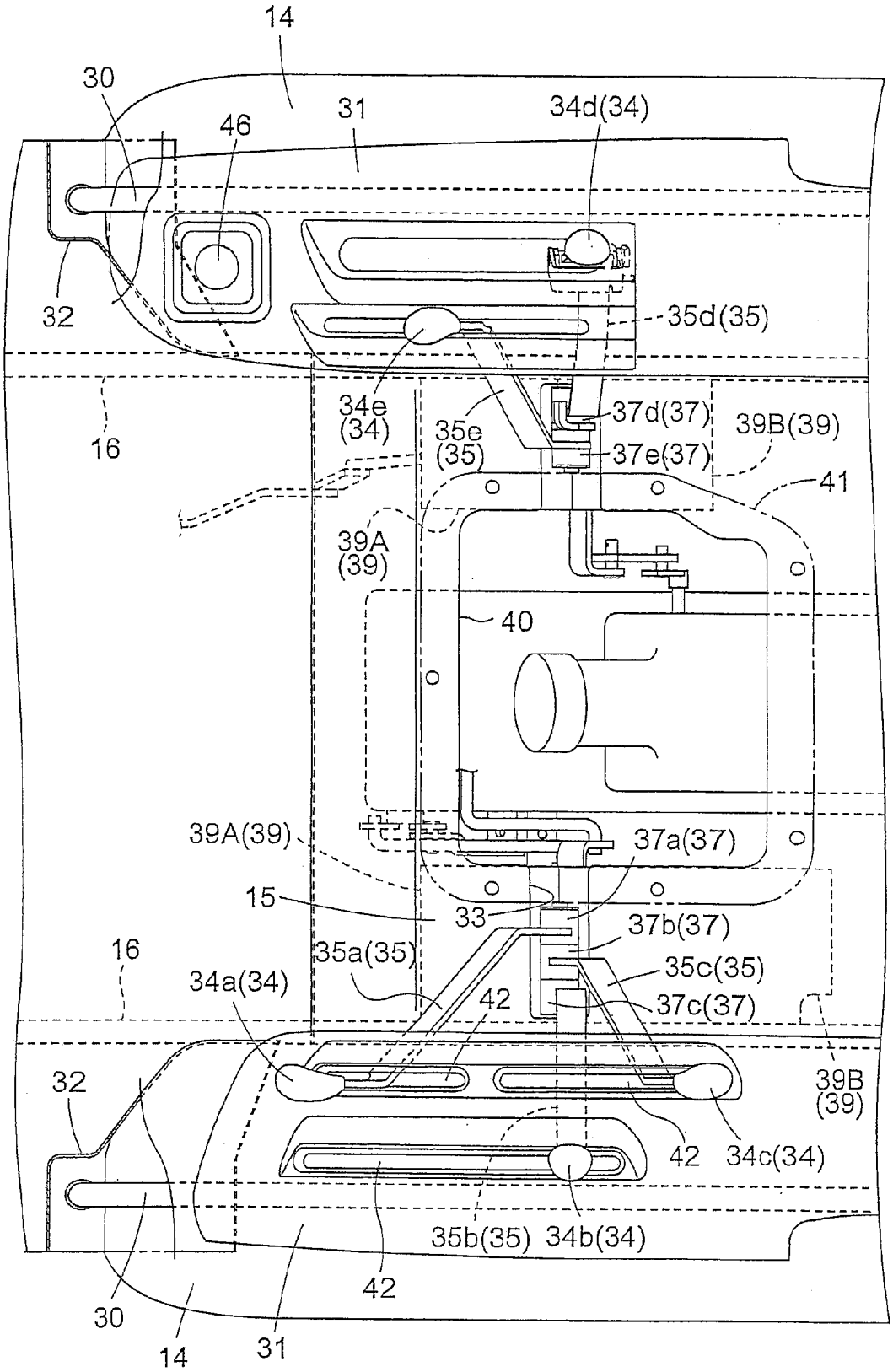
FIG. 4 is a top plan view of the vehicle control section.

As shown in FIGS. 2 to 4, the support frame member 9 of the cabin C further includes a floor panel support member 16 formed integrally therewith to extend in a vehicle longitudinal direction along a lower end portion of each of the right and left rear fenders 14 at an inner side portion in a vehicle transverse direction. The floor panel support member 16 has a forward portion arranged at a lower position extending along a step 17 and a rearward portion that is bent stepwise as viewed from the side and arranged at an upper position. The rearward portion of the floor panel support member 16 bears a load of the floor panel 15. More particularly, in the current embodiment, the frame structure of the tractor in the present invention is formed by the floor panel support member 16 and the floor panel 15 supported by the floor panel support member 16.

As shown in FIG. 4, a large opening 40 for maintenance work is formed in a central portion of the floor panel 15 in the vehicle width direction. The maintenance opening 40 is covered with a closing plate 41 fixedly attached to the opening from above. The driver's seat 7 is supported to the floor panel 15 through the closing plate 41.

More particularly, in the current embodiment, the space surrounded by the cabin C where the operator is present represents an operator-side space, and the space defined under the floor panel 15 including various devices controlled by the operator represents a device-side space.

Figure 7:
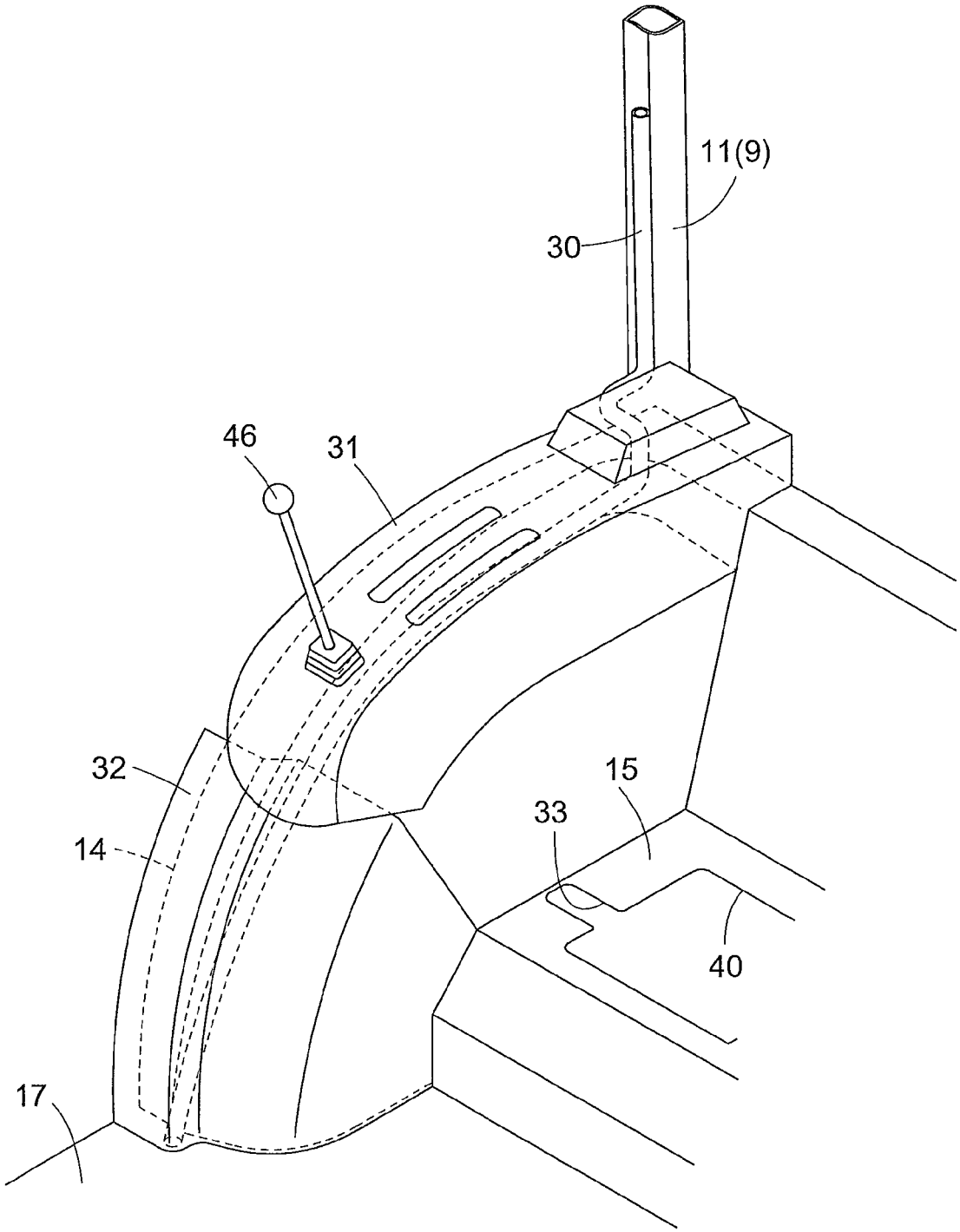
FIG. 7 is a perspective view of the vehicle control section.

As shown in FIG. 1, an air conditioner 29 is mounted in a forward portion of a ceiling portion 28 of the cabin C. The air conditioner 29 is provided with a pipe 30 for air conditioning including a drainage tube for discharging liquid waste produced by air conditioning operation to the outside and a power supply line. As shown in FIGS. 1 and 7, the pipe 30 for air conditioning extends from the air conditioner 29 along a lateral side portion of the ceiling frame 12, a lateral side portion of the rear pillar 11 and an upper portion of the rear fender 14 through the interior space of the cabin C.

As shown in FIG. 7, in a portion where the air-conditioning pipe 30 is provided along the upper portion of the ear fender 14, the air-conditioning pipe 30 is covered with a control panel 31 from above. An interior cover member 32 is provided in a region between a lower end portion of the control panel 31 and the step 17 to continue from the control panel 31 for covering the air conditioning pipe 30 from above.

A control lever 46 for controlling a front loader is provided in the front side of the control panel 31 positioned at the right side of the driver's seat 7. The control lever 46 is operatively connected to an unillustrated drive mechanism for controlling the front loader through a control wire (not shown). The control wire is also covered with the interior cover member 32. A sound-absorbing rubber mat (not shown) provided in the driver's section step 17 is hold at a lower end portion of the interior cover member 32, thereby to fix the control wire and the pipe 30.

Figure 5:
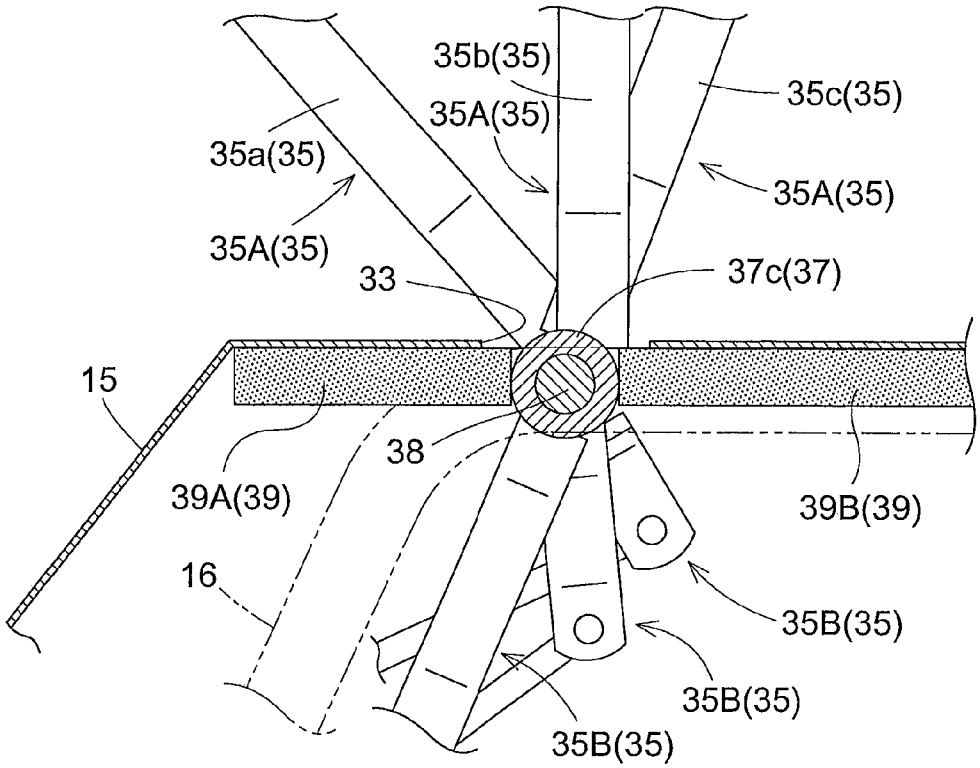
FIG. 5 is a side view of a support section of control levers.
Figure 6:
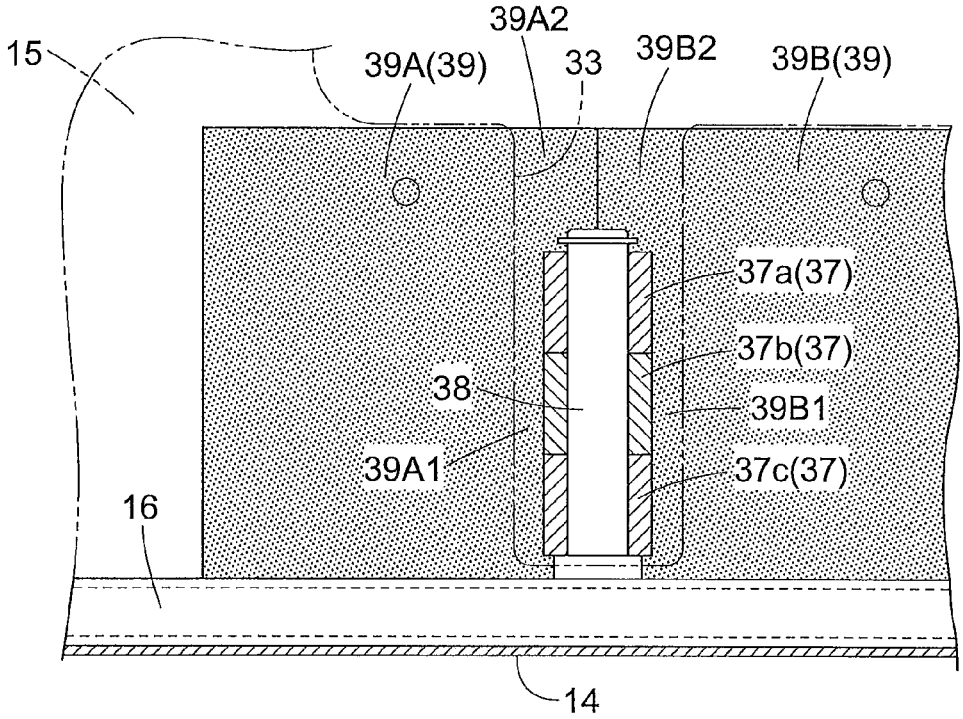
FIG. 6 is a top plan view of the support section of the control levers.

As shown in FIGS. 4 to 6, the floor panel 15 is cut away to continue from the maintenance opening 40 at opposite sides thereof in the vehicle transverse direction, thereby to form lever openings 33. A plurality of control levers 35 extend through the lever openings 33 formed in the floor panel 15. Each of the control levers 35 has a control lever portion 35A extending upward from the floor panel 15, that is, toward the operator-side space, and a controlled lever portion 35B extending downward from the floor panel 15, that is, toward the device-side space. A grip 34 is attached to an extreme end of the control lever portion 35A. A cylindrical boss portion 37 is provided in a transition portion 36 between the control lever portion 35A and the controlled lever portion 35B. The boss portion 37 is rotatably fitted on a pivotal shaft 38 attached to the floor panel support member 16. The pivotal shaft 38 extends in the vehicle transverse direction. More particularly, the control lever portion 35A extends from the boss portion 37 radially to the operator-side space while the controlled lever portion 35B extends from the boss portion 37 radially to the device-side space. Here, three control levers 35 (35*a*, 35*b*, 35*c*) are provided in the left side of the driver's section 7, and the boss portions 37 (37*a*, 37*b*, 37*c*) for the respective levers are arranged in the vicinity of the pivotal shaft 38. Further, two control levers 35 (35*d*, 35*e*) are provided in the right side of the driver's section 7, and the boss portions 37 (37*d*, 37*e*) for the respective levers are arranged in the vicinity of the pivotal shaft 38.

With the above-noted arrangement, each control lever 35 is oscillated in the vehicle longitudinal direction. The pivotal shaft 38 is arranged with its pivotal axis being positioned in the vicinity of the lever opening 33, slightly below the lever opening 33 in the current embodiment, while the boss portion 37 of the control lever 35 is arranged to slightly project from the lever opening 33 toward the operator-side space. Thus, gaps are formed between an edge portion of the floor panel 15 defining the lever opening 33 and the boss portion 37 and between the extreme end of the pivotal shaft 38 and the edge portion of the floor panel 15. In order to prevent foreign matters such as dust from entering the interior of the cabin C (operator-side space), a seal member 39 (39A, 39B) made of a sponge material or plastic material is provided to close the gaps. The material of the seal member 39 is not limited to the soft material, but may be a rigid material as long as the control lever 35 does not project toward the seal member 39 to be deformed within its oscillating range. In one aspect, the seal member 39 may have a substantially rectangular cross-sectional shape. The seal member 39 may be attached to a lower side surface of the floor panel 15 in tight contact with the lower side surface such that a terminal edge of the seal member 39 comes into contact with an outer periphery of the boss portion 37 over and across an axial length of the boss portion 37.

The three control levers 35 positioned at the left side of the vehicle body are a PTO engaging/disengaging control lever 35*a* operatively connected to a transmission section (not shown) of a transmission case 3A housing a transmission mechanism therein for the traveling vehicle body 3 through a relay link 45*a* for supplying and breaking power for a power-take-off shaft (not shown), a PTO speed-change control lever 35*b* operatively connected to the transmission case 3A through a relay link 45*b* for changing speed for the power-take-off shaft, and an auxiliary speed-change control lever 35*c* operatively connected to an auxiliary transmission device (not shown) provided in a propelling transmission mechanism for the traveling vehicle body 3 through a relay link 45*c*.

The two control levers 35 positioned at the right side of the vehicle body are an elevation control lever 35*d* operatively connected to a control valve (not shown) of the transmission case 3A through a relay link 45*d* for raising and lowering a work implement (not shown) connected to the rear portion of the vehicle body, and a cruising control lever 35*e* operatively connected to the transmission section (not shown) of the transmission case 3A through a relay link 45*e* for switching the vehicle state between a cruising state for propelling the vehicle at constant speed and a releasing state.

As understood from FIG. 6, the pivotal shaft 38 for supporting the three left-side control levers 35*a*, 35*b* and 35*c* is cantilevered to fixedly extend inwardly in the vehicle transverse direction from an intermediate portion of the left side of the floor panel support member 16. The lever opening 33 is a rectangular slot formed along a longitudinal direction of the pivotal shaft 38 in a position of the floor panel 15 corresponding to an upper side portion of the pivotal shaft 38.

The large maintenance opening 40 as noted above is formed in the floor panel 15 to continue from the slot-like lever openings 33. Since the opening 40 is closed with the closing plate 41 from above, only the lever openings 33 remain visible when the closing plate 41 is attached to the opening 40.

The boss portions 37*a*, 37*b* and 37*c* for the three control levers 35*a*, 35*b* and 35*c* are rotatably supported to the pivotal shaft 38 to be arranged adjacent to each other in the axial direction of the pivotal shaft 38. The control levers 35*a*, 35*b* and 35*c* have proximal portions welded to the corresponding boss portions 37*a*, 37*b* and 37*c* and extend in different directions from the boss portions 37*a*, 37*b* and 37*c* to extend through respective guide slots 42 formed in the control panel 31.

As shown in FIGS. 5 and 6, the seal member 39 is provided to slide-contact the radial opposite sides of the boss portions 37*a*, 37*b* and 37*c* of the three control levers 35*a*, 35*b* and 35*c* and to come into tight contact with the back surface side of the floor panel 15. The seal member 39 closes the gap between each of the boss portions 37*a*, 37*c* and 37*c* and the floor panel 15 and the gap between the pivotal shaft 38 and the floor panel 15.

As shown in FIG. 6, the seal member 39 is divided into two parts in the vehicle longitudinal direction to include a front-side seal unit member 39A positioned forwardly of the axis of the pivotal shaft 38 in the vehicle longitudinal direction and a rear-side seal unit member 39B positioned rearwardly of the axis of the pivotal shaft 38 in the vehicle longitudinal direction. The front-side seal unit member 39A is configured to come into slide contact with front portions of the three boss portions 37*a*, 37*b* and 37*c* in outer circumferences thereof while the rear-side seal unit member 39B is configured to come into slide contact with rear portions of the three boss portions 37*a*, 37*b* and 37*c* in the outer circumferences.

More particularly, the front-side seal unit member 39A and the rear-side seal unit member 39B are configured to come into slide contact with the outer circumferences of the three boss portions 37*a*, 37*b* and 37*c* at left-side (lower-side in FIG. 6) portions 39A1 and 39B1 corresponding to the boss portions 37*a*, 37*b* and 37*c*, and configured to extend close to each other beyond the outer circumferences of the boss portions 37*a*, 37*b* and 37*c* at outward portions 39A2 and 39B2 in the extreme end portion of the pivotal shaft 38 where the boss portions 37*a*, 37*b* and 37*c* are absent, as a result of which the front seal unit member 39A and rear seal unit member 39B abut against each other to close the lever openings 33 so as not to produce any gaps between the boss portions 37*a*, 37*b* and 37*c* and the floor panel 15.

As shown in FIGS. 2 to 6, the left-side seal member 39 has a width greater than the vehicle longitudinal width of the opening 41 and the right-side seal member 39 has a width approximate to the vehicle longitudinal width of the opening 41. Thus, in addition to the dustproof function, the seal member 39 has a function to prevent vehicle vibrations produced by the transmission case 3A, for example, from being transmitted to the driver's seat 7.

Similarly, with respect to the two control levers 35*d* and 35*e* positioned at the right side of the driver's seat 7, the seal member 39 having the similar construction to the one for the left-side three control levers 35*a*, 35*b* and 35*c* is configured to seal between the boss portions 37*d* and 37*e* and the floor panel 15. The right-side pivotal shaft 38 and the left-side pivotal shaft 38 are coaxially mounted or aligned with each other.

Instead, the right-side pivotal shaft 38 and the left-side pivotal shaft 38 may not be coaxial with each other.

Modified Embodiments

[1] In the above-noted embodiment, the cabin C is provided to cover the surroundings of the vehicle control section 8. Instead, the work vehicle may dispense with the cabin C.

[2] In the above-noted embodiment, the seal member 39 is divided into two parts. Instead, the seal member 39 may be a one-piece unit or may be divided into three parts or more.

[3] In the above-noted embodiment, the respective boss portions 37 (37*a*, 37*b*, 37*c*) of the plurality of control levers 35 (35*a*, 35*b*, 35*c*) are arranged adjacent to each other in the axial direction on a single pivotal shaft 38. Instead, the boss portion 37 of a single control lever 35 may be rotatably mounted on a single pivotal shaft 38.

[4] In the above-noted embodiment, the work vehicle is represented by the tractor. Instead, the work vehicle may be any other type of work vehicle such as a combine harvester or a ride-on rice planting machine, for example.

What is claimed is:

1. A control lever system for a work vehicle having a frame structure delimiting between an operator-side space adjacent to an operator and a device-side space adjacent controlled devices, the control lever system comprising:

a floor panel having a flat surface portion, the floor panel forming a part of the frame structure;

a pivotal shaft extending along the floor panel and mounted adjacent a lever opening formed in the flat surface portion;

a boss portion supported to the pivotal shaft to be rotatable about the pivotal shaft;

a control lever portion radially extending from the boss portion to the operator-side space;

a controlled lever portion radially extending from the boss portion to the device-side space; and a seal member for closing a gap between the boss portion and an area of the flat surface portion where the lever opening is formed, the boss portion coming into contact with a portion of the seal member adjacent the boss portion, wherein the seal member has a substantially rectangular cross-sectional shape, the seal member being attached to a lower side surface of the flat surface portion such that a terminal edge of the seal member comes into direct contact with an outer periphery of the boss portion over and across an axial length of the boss portion.

2. The control lever system as defined in claim 1, wherein the seal member is made of an elastic material for absorbing projecting displacement of the control lever.

3. The control lever system as defined in claim 1, wherein the seal member is arranged adjacent to the device-side space of the frame structure.

4. The control lever system as defined in claim 1, wherein a cabin is provided in the operator-side space for the operator, the frame structure includes a floor panel support member that supports the floor panel of the cabin, and the pivotal shaft is fixed to the floor panel support member.

5. The control lever system as defined in claim 4, wherein the pivotal shaft extends along an upper surface of the floor panel, and at least a portion of the boss portion is positioned adjacent the device-side space from the upper surface of the floor panel.

6. A control lever system for a work vehicle having a frame structure delimiting between an operator-side space adjacent to an operator and a device-side space adjacent controlled devices, the control lever system comprising:

a pivotal shaft extending along the frame structure and mounted adjacent a lever opening formed in the frame structure;

a plurality of boss portions supported to the pivotal shaft to be rotatable about the pivotal shaft;

control lever portions radially extending from the respective boss portions to the operator-side space;

controlled lever portions radially extending from the respective boss portions to the device-side space; and a seal member mounted on the frame structure for closing a gap between all the boss portions and an area of the frame structure where the lever opening is formed, the boss portion coming into direct contact with a portion of the seal member adjacent the boss portion.

7. The control lever system as defined in claim 6, wherein the plurality of boss portions are cylindrical members having the same diameter.

8. The control lever system as defined in claim 6, wherein the seal member is made of an elastic material for absorbing projecting displacement of the control lever.

9. The control lever system as defined in claim 6, wherein the seal member is arranged adjacent to the device-side space of the frame structure.

10. The control lever system as defined in claim 6, wherein a cabin is provided in the operator-side space for the operator, the frame structure includes a floor panel support member that supports the floor panel of the cabin, and the pivotal shaft is fixed to the floor panel support member.

11. The control lever system as defined in claim 10, wherein the pivotal shaft extends along an upper surface of the floor panel, all the boss portions have the same outer shape, and at least a portion of the boss portions is positioned adjacent the device-side space from the upper surface of the floor panel.

* * * * *